US009857074B2

(12) United States Patent
Ogata et al.

(10) Patent No.: US 9,857,074 B2
(45) Date of Patent: Jan. 2, 2018

(54) BOILER WATER SUPPLY PREHEATER SYSTEM AND BOILER WATER SUPPLY PREHEATING METHOD

(71) Applicant: IHI CORPORATION, Tokyo (JP)

(72) Inventors: Hideki Ogata, Tokyo (JP); Toshiro Fujimori, Tokyo (JP); Kazuo Miyoshi, Tokyo (JP); Ryo Akiyoshi, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 15/000,333

(22) Filed: Jan. 19, 2016

(65) Prior Publication Data

US 2016/0138797 A1 May 19, 2016

Related U.S. Application Data

(63) Continuation of application No. PCT/JP2014/069541, filed on Jul. 24, 2014.

(30) Foreign Application Priority Data

Jul. 26, 2013 (JP) ..... 2013-155754

(51) Int. Cl.

| | |
|---|---|
| ***F22D 1/32*** | (2006.01) |
| ***F22D 1/18*** | (2006.01) |
| ***F22D 1/02*** | (2006.01) |
| ***F01K 23/04*** | (2006.01) |
| ***F22D 11/00*** | (2006.01) |

(52) U.S. Cl.

CPC ..... *F22D 1/02* (2013.01); *F01K 23/04* (2013.01); *F22D 1/18* (2013.01); *F22D 1/32* (2013.01); *F22D 11/00* (2013.01)

(58) Field of Classification Search

CPC ..... F01K 23/04; F01K 3/262; F22D 1/003; F22D 1/32; F22D 11/00; F22D 1/18

USPC ..... 122/1 C, 406.1, 414, 415

See application file for complete search history.

(56) References Cited

U.S. PATENT DOCUMENTS

| | | | | |
|---|---|---|---|---|
| 5,687,674 | A * | 11/1997 | Johanntgen | F22D 1/36 110/234 |
| 6,230,480 | B1 * | 5/2001 | Rollins, III | F01K 23/105 122/7 B |
| 9,091,182 | B2 * | 7/2015 | Labbe | F01K 7/40 |
| 9,316,122 | B2 * | 4/2016 | Labbe | F01K 7/40 |
| 2012/0297774 | A1 | 11/2012 | Uji | |

(Continued)

FOREIGN PATENT DOCUMENTS

| | | |
|---|---|---|
| JP | 64-087811 A | 3/1989 |
| JP | 06-241006 A | 8/1994 |

(Continued)

OTHER PUBLICATIONS

International Search Report, PCT/JP2014/069541, dated Oct. 28, 2014, 2 pgs.

*Primary Examiner* — Gregory A Wilson

(74) *Attorney, Agent, or Firm* — Volpe and Koenig, P.C.

(57) ABSTRACT

The present disclosure relates to a boiler water supply preheater system which preheats water (boiler water supply) supplied to a boiler by a predetermined preheating means, wherein the preheating means is a Rankine cycle (thermal cycle) which moves heat of a waste heat source in the boiler to the boiler water supply to perform preheating and drives a generator to generate electric power using a heat medium.

9 Claims, 2 Drawing Sheets

(56) References Cited

U.S. PATENT DOCUMENTS

| | | | | |
|---|---|---|---|---|
| 2013/0086904 | A1* | 4/2013 | Bent | F01K 13/00 60/641.8 |
| 2014/0366537 | A1* | 12/2014 | Hellweg | F01K 7/24 60/645 |
| 2015/0121876 | A1* | 5/2015 | Okaichi | F01K 9/003 60/670 |
| 2015/0369084 | A1* | 12/2015 | Levin | F22D 1/003 60/676 |
| 2016/0109138 | A1* | 4/2016 | Kang | F25B 27/02 60/645 |

FOREIGN PATENT DOCUMENTS

| | | | | |
|---|---|---|---|---|
| JP | 08-093412 | A | 4/1996 | |
| JP | 10-030407 | A | 2/1998 | |
| JP | 2000-045713 | A | 2/2000 | |
| JP | 2003-336504 | A | 11/2003 | |
| JP | 2011-214451 | A | 10/2011 | |
| JP | 05-062380 | B | 10/2012 | |
| JP | 2012-198018 | A | 10/2012 | |
| JP | 2013-011272 | A | 1/2013 | |
| JP | 2015110943 | A * | 6/2015 | F01K 9/003 |
| WO | 03/098007 | A1 | 11/2003 | |

* cited by examiner

BOILER WATER SUPPLY PREHEATER SYSTEM AND BOILER WATER SUPPLY PREHEATING METHOD

This application is a continuation application based on a PCT Patent Application No. PCT/JP2014/069541, filed Jul. 24, 2014, whose priority is claimed on Japanese Patent Application No. 2013-155754, filed Jul. 26, 2013. The contents of both the PCT application and the Japanese Patent Application are incorporated herein by reference.

TECHNICAL FIELD

Embodiments described herein relates to a boiler water supply preheater system and a method of preheating a boiler water supply.

BACKGROUND ART

In the technical field of boilers, for example, as in an exhaust heat recovery boiler disclosed in Patent Document 1 described below, a water supply method of converting (vaporizing) the water supply into water vapor after previously heating (preheating) the water supply using an exhaust gas (hot gas) of a gas turbine is performed. That is, the water supply method includes heating (pre-heating) the water supply with the combustion exhaust gas using a heat exchanger. In the boiler system using such a water supply method, the water supply after the preheating is converted into the water vapor in a boiler main body.

DOCUMENT OF RELATED ART

Patent Document

[Patent Document 1]

Japanese Unexamined Patent Application, First Publication No H08-93412

SUMMARY

Technical Problem

Incidentally, the above-described water supply method is a measure for improving the energy efficiency (boiler efficiency) of the boiler system. However, recently in the boiler market, an improvement in an amount of recovery of available energy in the boiler system is desired rather than a simple increase in boiler efficiency. Therefore, it is necessary for boiler manufacturers to precisely answer the needs of the market.

Further, the available energy is a thermodynamic concept also called exergy, and is generally known as energy that is possible to be extracted as the mechanical work from a system. The available energy in the present disclosure refers to energy (amount of work) that can be recovered as mechanical work (power such as electricity) of the total energy included in a heat source of the boiler.

An object of the present disclosure is to provide a boiler water supply preheater system and a method of preheating the boiler water supply in which a recovery amount of the available energy is higher than in the related art.

Solution to Problem

According to a first aspect of the present disclosure, there is provided a boiler water supply preheater system which preheats water (boiler water supply) supplied to a boiler by a predetermined preheating means, wherein the preheating means is a thermal cycle which moves heat of a waste heat source in the boiler to the boiler water supply to perform preheating and generates electric power using a predetermined heat medium.

According to a second aspect of the boiler water supply preheater system of the present disclosure, in the first aspect, the preheating means may be equipped with an auxiliary heat exchanger which exchanges heat between the waste heat source and the boiler water supply to preheat the boiler water supply, in addition to the thermal cycle.

According to a third aspect according to the boiler water supply preheater system of the present disclosure, in the first or second aspect, the waste heat source may be drained hot water obtained by using the water vapor generated by the boiler as a predetermined application.

According to a fourth aspect of the boiler water supply preheater system of the present disclosure, in the third aspect, the heat medium may be a low-boiling-point heat medium having a lower boiling point than water.

According to a fifth aspect of the of the boiler water supply preheater system of the present disclosure, in the first or second aspect, the waste heat source may be a combustion exhaust gas generated in the combustor of the boiler.

According to a sixth aspect of the of the boiler water supply preheater system of the present disclosure, in the fifth aspect, the heat medium may be a high-boiling-point heat medium having a higher boiling point than water.

Moreover, according to another aspect of the present disclosure, there is provided a method of preheating a boiler water supply in which water (a boiler water supply) supplied to a boiler is preheated, the method including: moving heat of a waste heat source in the boiler to the boiler water supply to perform preheating and generating electric power using a predetermined thermal cycle.

Effects

According to the present disclosure, since the system has a thermal cycle which moves heat of a waste heat source in the boiler to the boiler water supply to perform preheating and generates electric power, it is possible to provide a boiler water supply preheater system and a method of preheating the boiler water supply which have a higher recovery amount of available energy (exergy) than the related art in which heat is simply exchanged between a waste heat source and a boiler water supply to preheat the boiler water supply.

DESCRIPTION OF EMBODIMENTS

Hereinafter, a boiler water supply preheater system according to an embodiment of the present disclosure will be described with reference to the drawings.

Figure 1:
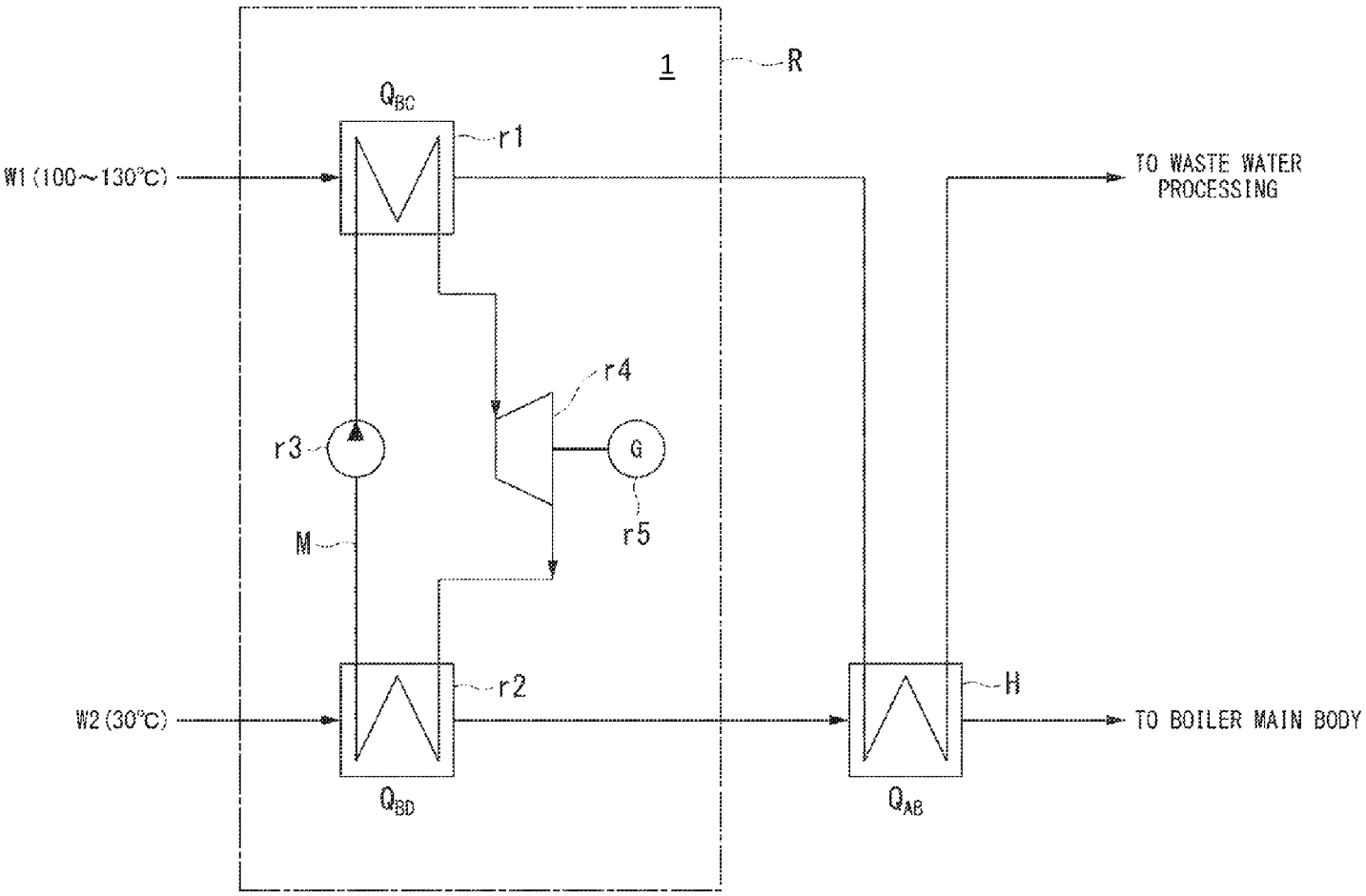
FIG. 1 is a system configuration diagram of a boiler water supply preheater system according to an embodiment of the present disclosure.

A boiler water supply preheater system 1 of the present disclosure preheats water (boiler water supply W2) supplied to a boiler using drained hot water W1 as illustrated in FIG. 1, and is configured to include a Rankine cycle R and an auxiliary heat exchanger H. The drained hot water W1 is, for example, hot water of about 100 to 130° C. which is obtained as a result of using the water vapor generated in the boiler as a predetermined application. For example, in the case of a boiler that generates the water vapor for driving a steam turbine, the drained hot water W1 is condensed water which is recovered by condensation of the water vapor by driving the steam turbine. The boiler water supply W2 is water supplied to the boiler as described above, and dependence of the boiler on the system configuration, but for example, is about 20 to 50° C., and preferably 30° C.

The Rankine cycle R is a thermal cycle using a heat medium M (a low-boiling-point heat medium) with a boiling point lower than water, and includes a first heat exchanger r1, a second heat exchanger r2, a pump r3, a turbine r4 and a generator r5 as illustrated in FIG. 1. The heat medium M, for example, is benzene, a fluorocarbon, a silicone oil, etc.

The first heat exchanger r1 is a device which exchanges heat between the heat medium M of the liquid state supplied from the pump r3 and the drained hot water W1. The heat medium M of the liquid state is changed to a gaseous state by being heated in the first heat exchanger r1, and is supplied to the turbine r4. That is, the first heat exchanger r1 functions as a vaporizer for the heat medium M and functions as a cooler for the hot water W1.

The second heat exchanger r2 is a device which exchanges heat between the heat medium M recovered from the turbine r4 and the boiler water supply W2. The heat medium M enters a fully condensed liquid state by being cooled in the second heat exchanger r2 and is supplied to the pump r3. That is, the second heat exchanger r2 functions as a condenser for the heat medium M and functions as a heater for the boiler water supply W2.

The pump r3 is provided between the first heat exchanger r1 and the second heat exchanger r2 as illustrated to circulate the heat medium M within the Rankine cycle R. The turbine r4 is a power source which rotates using the heat medium M of the gaseous state supplied from the first heat exchanger r1 as a driving medium, and is provided between the first heat exchanger r1 and the second heat exchanger r2 as illustrated. That is, the heat medium M of the gaseous state supplied to the turbine r4 is a compressed gas vaporized in the first heat exchanger r1, and generates rotational power in the turbine r4. A rotary shaft of the generator r5 is axially coupled to the turbine r4, and generates AC power P by rotating through the turbine r4.

In such a Rankine cycle R, the heat medium M of the liquid state is supplied to the first heat exchanger r1 from the second heat exchanger r2 via the pump r3, and the heat medium M of the gaseous state is supplied to the second heat exchanger r2 from the first heat exchanger r1 via the turbine r4. In other words, in the Rankine cycle R, the heat medium M circulates through the second heat exchanger r2, the pump r3, the first heat exchanger r1 and the turbine r4, while repeating the state changes between liquid and gas.

In addition, such a Rankine cycle R moves heat of the drained hot water W1 to the boiler water supply W2 by passing through the heat medium M to heat the boiler water supply W2 (temperature rise), and generates the power by driving the turbine r4 using the heat medium M. That is, the Rankine cycle R in this embodiment has both the heat transportation function and the power generation function.

The auxiliary heat exchanger H is a device which exchanges heat between the drained hot water W1 passing through the first heat exchanger r1 and the boiler water supply W2 passing through the second heat exchanger r2. The temperature of the drained hot water W1 supplied to the auxiliary heat exchanger H from the first heat exchanger r1 is at a temperature higher than the temperature of the boiler water supply W2 supplied to the auxiliary heat exchanger H from the second heat exchanger r2. Thus, the boiler water supply W2 is further heated (temperature rise) in the auxiliary heat exchanger H.

The boiler water supply W2 passing through the auxiliary heat exchanger H is hot water which is temporarily preheated by the Rankine cycle R and is further secondarily pre-heated by the auxiliary heat exchanger H, and is supplied to the boiler as the preheated water. Meanwhile, the drained hot water W1 passing through the Rankine cycle R is cooled by the auxiliary heat exchanger H, and is supplied to a waste water processing device, while being further cooled by the auxiliary heat exchanger H.

Next, the operation of the boiler water supply preheater system of the present disclosure thus configured will be described in detail with reference to FIG. 2.

In the boiler water supply preheater system of the present disclosure, the drained hot water W1 first passes through the first heat exchanger r1, and is supplied to the waste water processing device after further passing through the auxiliary heat exchanger H. Meanwhile, the boiler water supply W2 passes through the second heat exchanger r2, and is supplied to the boiler as preheated water after passing through the auxiliary heat exchanger H. For example, the drained hot water W1 is cooled to, for example, 80 to 90° C. by heat exchange with the heat medium M of the liquid state in the first heat exchanger r1, and meanwhile, the boiler water supply W2 is heated (preheated), for example, to the vicinity of 40° C. by heat exchange with the heat medium M of the gaseous state in the second heat exchanger r2.

Further, the drained hot water W1 is cooled, for example, to the vicinity of 50° C. by heat exchange with the boiler water supply W2 in the auxiliary heat exchanger H, and meanwhile, the boiler water supply W2 is heated (preheated), for example, to the vicinity of 65° C. by heat exchange with the drained hot water W1 in the auxiliary heat exchanger H. That is, since the heat of the drained hot water W1 moves to the boiler water supply W2 by the Rankine cycle R and the auxiliary heat exchanger H, the boiler water supply W2 is heated (preheated), for example, to the vicinity of 65° C.

Figure 2:
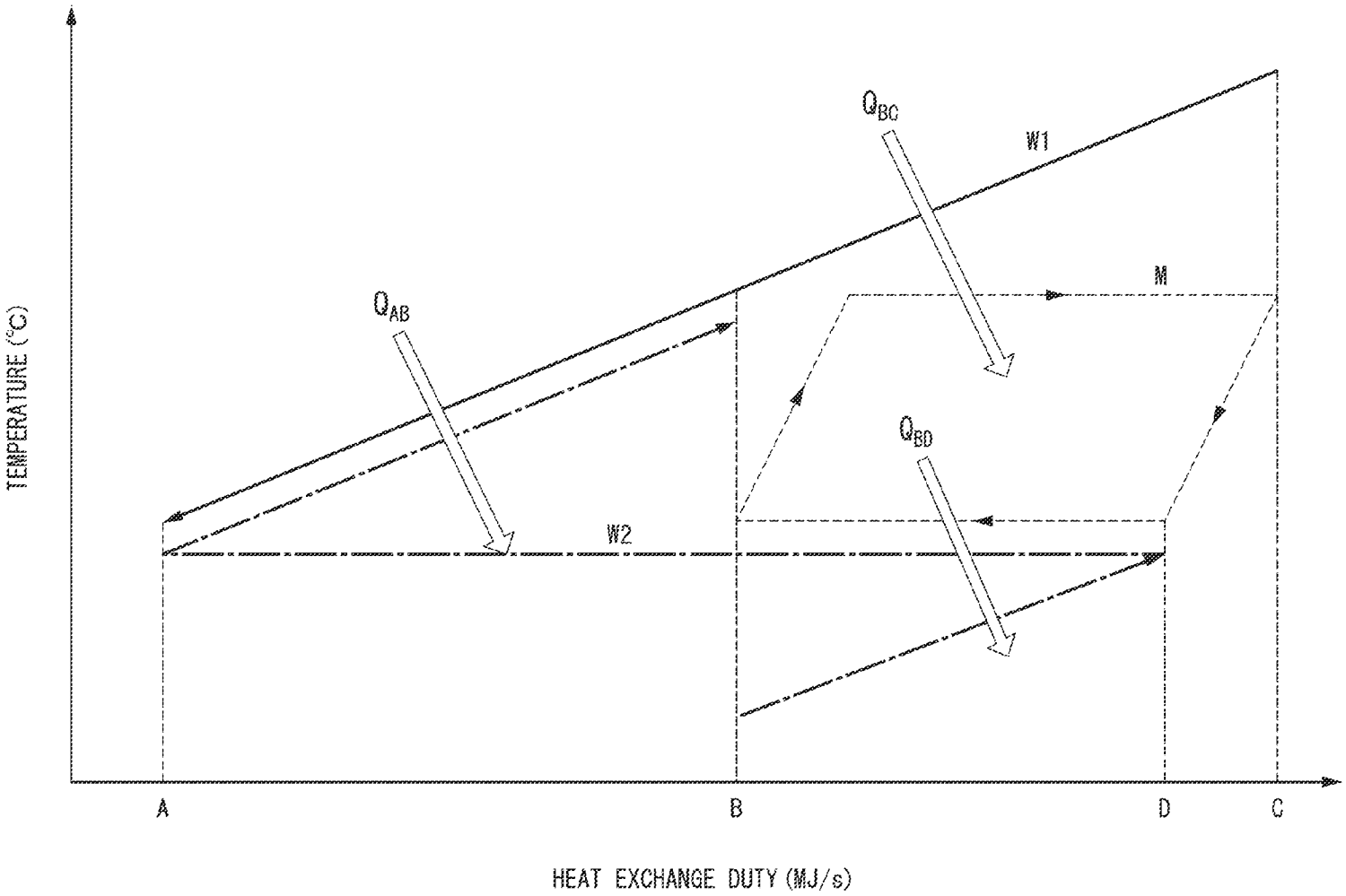
FIG. 2 is a characteristic diagram illustrating the operation of the boiler water supply preheater system according to an embodiment of the present disclosure.

FIG. 2 is a characteristic diagram illustrating the mutual heat exchange state of the drained hot water W1, the boiler water supply W2 and the heat medium M by a relation between the amount of heat exchange (horizontal axis) and the temperature (vertical axis). In FIG. 2, the solid line indicates the heat exchange state of the drained hot water W1, the dashed line illustrates the heat exchange state of the boiler water supply W2, and the broken line indicates the heat exchange state of the heat medium M.

First, an area B-D of the horizontal axis indicates a heat exchange process between the boiler water supply W2 and the heat medium M of the gaseous state in the second heat exchanger r2, and a total heat quantity $Q_{BD}$ moves from the heat medium M of the gaseous state to the boiler water supply W2. That is, in the area B-D, the temperature of the boiler water supply W2 rises from about 30° C. (initial temperature) to the vicinity of about 40° C., and meanwhile, the heat medium M of the gaseous state sequentially changes from gas to liquid at a predetermined condensation temperature. Further, an area D-C of the horizontal axis indicates a heat exchange process in which the heat medium M of the gaseous state is cooled to the vicinity of the condensation temperature by the turbine r4.

An area B-C of the horizontal axis indicates a heat exchange process between the drained hot water W1 and the heat medium M of the liquid state in the first heat exchanger r1, and a total heat quantity $Q_{BC}$ moves from the drained hot water W1 to the heat medium M of the liquid state. That is, in the area B-C, as the heat medium M of the liquid state is gradually heated, the state of the drained hot water W1 sequentially changes from liquid to gas at a predetermined evaporation temperature, and meanwhile, the drained hot water W1 is cooled from 100 to 130° C. to 80 to 90° C.

Further an area A-B of the horizontal axis indicates a heat exchange process between the drained hot water W1 and the boiler water supply W2 in the auxiliary heat exchanger H, and the total heat amount $Q_{AB}$ moves from the drained hot water W1 to the boiler water supply W2. That is, in the area A-B, the boiler water supply W2 heated to the vicinity of 40° C. by the second heat exchanger r2 is further heated to the vicinity of 65° C. by the drained hot water W1, and meanwhile, the drained hot water W1 cooled to 80 to 90° C. by the first heat exchanger r1 is cooled to the vicinity of 50° C.

Further, at the same time, in the Rankine cycle R, the heat medium M mechanically acts on the turbine r4 as a driving medium to generate the mechanical power, and the generator r5 is rotated by the mechanical power of the turbine r4 to generate an AC power P. That is, in the boiler water supply preheater system of the present disclosure, in addition to pre-heating of the boiler water supply W2 by providing the Rankine cycle R, AC power P is generated.

Here, when the available energy efficiency (exergy efficiency) of the electric power is assumed to be "1," as is well known, since the thermal energy cannot be 100% converted into electric power, the available energy efficiency is lower than the electric power. If the Rankine cycle R is removed and the boiler water supply W2 is heated (preheated) to 65° C. using only the auxiliary heat exchanger H, the available energy acquired by the boiler water supply W2 from the drained hot water W1 is 1505 kW (=kJ/s) as an estimated example. When the temperature of the drained hot water W1 is assumed to be, for example, 102° C., since the maximum available energy of the drained hot water W1, for example, is 3478 kW (=kJ/s), the available energy utilization is 43.3% (=1505/3478).

In contrast, in the boiler water supply preheater system of the present disclosure, since the available energy of the AC power P is obtained from the drained hot water W1 in addition to the available energy "1505 kW (=kJ/s)," it is possible to obtain the naturally larger available energy than when the Rankine cycle R is removed and the boiler water supply W2 is heated (preheated) to 65° C. using only the auxiliary heat exchanger H. For example, when the AC power P of 577 kW is obtained by the generator r5, the available energy utilization is 59.9% (=2082/3478).

Further, the present disclosure is not limited to the above-described embodiments, and for example, the following modified examples are considered.

(1) In the above embodiment, the Rankine cycle R is configured to heat (raise the temperature of) the boiler water supply W2 using the drained hot water W1, but the present disclosure is not limited thereto. As the waste heat generated in the boiler, there are various kinds in addition to the drained hot water W1. For example, the combustion exhaust gas generated in the combustor is a waste heat source having a higher temperature (hundreds of ° C.) than the drained hot water W1, and the combustion exhaust gas can be considered to be used instead of the boiler water supply W2.

Moreover, using the combustion exhaust gas and the boiler water supply W2 as waste heat sources as needed can be considered. In this case, for example, the Rankine cycle is configured to heat (raise the temperature of) the boiler water supply W2 using the combustion exhaust gas, and in the auxiliary heat exchanger H, heating (raising the temperature of) the boiler water supply W2 using the drained hot water W1 as in the above embodiments can be considered.

(2) In the above embodiment, the Rankine cycle R is configured using the heat medium M (low-boiling-point heat medium) having a lower boiling point than water, but the present disclosure is not limited thereto. For example, a medium other than the illustrated heat medium may be used as a low-boiling-point heat medium, and furthermore, the high-boiling-point heat medium having a higher boiling point than water may be used in place of the low-boiling-point heat medium. In particular, when the above-described combustion gas is used as a waste heat source, since the temperature of the combustion exhaust gas is several hundred ° C. that is considerably higher than the boiling point of water, it is possible to use a high-boiling-point heat medium.

Further, when the combustion exhaust gas is used as a waste heat source, providing a plurality of the Rankine cycles can be considered. That is, a plurality of the Rankine cycles are provided toward the downstream side from the upstream side of the combustion exhaust gas and the boiler water supply W2, the high-boiling-point heat medium can be used on the upstream side, that is, in the Rankine cycle in which the temperature of the combustion exhaust gas is relatively high, and the low-boiling-point heat medium can be used on the downstream side, that is, in the Rankine cycle in which the temperature of the combustion exhaust gas is relatively low.

Further, when the combustion exhaust gas is used as a waste heat source, providing an additional heat exchanger in the Rankine cycle can be considered. That is, after heating the heat medium M by the drained hot water W1, the heat medium M is further heated in the heat exchanger into which the combustion exhaust gas is introduced. When the maximum temperature of the heat medium M is defined as "TH" and the condensation temperature of the heat medium M is defined as "TC," since the efficiency of the Rankine cycle is defined as 1−(TC/TH), as the maximum temperature TH of the heat medium M increases, the cycle efficiency is improved.

(3) In the above embodiment, the auxiliary heat exchanger H which secondarily preheats the boiler water supply W2 is provided, but the present disclosure is not limited thereto. The auxiliary heat exchanger H may be deleted if necessary.

(4) In the above embodiment, the boiler water supply W2 was subjected to heating (preheating), but the present disclosure is not limited thereto. The combustion air supplied to the combustor of the boiler may be subjected to heating (preheating).

(5) Moreover, when the drained water serving as a high-temperature heat source is sufficiently clean (satisfies the standards of the boiler water supply), the drained hot water W1 supplied to the waste water processing device from the auxiliary heat exchanger H may be reused as the boiler water supply W2. In this case, the total amount of the boiler water supply W2 may be supplied by the drained hot water W1, or a part of the boiler water supply W2 may be supplied by the drained hot water W1. In this way, by reusing the drained hot water W1 as the boiler water supply W2, it is possible to effectively utilize the holding heat quantity of the drained hot water W1. Further, when a part of the boiler water supply W2 is supplied by the drained hot water W1, it is desirable to perform mixing at a point at which the temperature of the boiler water supply W2 during heating of the boiler water supply W2 is the same as the temperature of the drained hot water W1.

INDUSTRIAL APPLICABILITY

The present disclosure provides a boiler water supply preheater system and a method of preheating the boiler water supply in which the amount of recovery of the available energy (exergy) is higher than in the related art.

The invention claimed is:

1. A boiler water supply preheater system which preheats boiler feed water supplied to a boiler by a predetermined preheating means, wherein the predetermined preheating means is a thermal cycle which moves heat from a fluid that is a waste heat source in the boiler to the boiler feed water with a predetermined heat medium to perform preheating of the boiler feed water and generates electric power with the predetermined heat medium, and the thermal cycle includes a heat exchanger that moves heat from the waste heat source to the predetermined heat medium.

2. The boiler water supply preheater system of claim 1, wherein the preheating means is equipped with an auxiliary heat exchanger which exchanges heat between the waste heat source and the boiler feed water to preheat the boiler feed water, in addition to the thermal cycle.

3. The boiler water supply preheater system of claim 2, wherein the waste heat source is drained hot water obtained by using water vapor generated by the boiler as a predetermined application.

4. The boiler water supply preheater system of claim 3, wherein the predetermined heat medium is a low-boiling-point heat medium having a lower boiling point than water.

5. The boiler water supply preheater system of claim 2, wherein the predetermined heat medium is a high-boiling-point heat medium having a higher boiling point than water.

6. The boiler water supply preheater system of claim 1, wherein the waste heat source is drained hot water obtained by using water vapor generated by the boiler as a predetermined application.

7. The boiler water supply preheater system of claim 6, wherein the predetermined heat medium is a low-boiling-point heat medium having a lower boiling point than water.

8. The boiler water supply preheater system of claim 1, wherein the predetermined heat medium is a high-boiling-point heat medium having a higher boiling point than water.

9. A method of preheating boiler water supply in which boiler feed water supplied to a boiler is preheated, the method comprising:

moving heat from a fluid that is a waste heat source in the boiler to the boiler feed water with a predetermined heat medium using a predetermined thermal cycle which includes a heat exchanger to perform preheating of the boiler feed water, and generating electric power with the predetermined heat medium using the predetermined thermal cycle, and wherein the heat exchanger moves heat from the waste heat source to the predetermined heat medium.

* * * * *